US006175976B1

(12) United States Patent
Cantwell

(10) Patent No.: US 6,175,976 B1
(45) Date of Patent: Jan. 23, 2001

(54) SLEEPING BAG WITH ADJUSTABLE FOOT SPACE

(75) Inventor: Robert R. Cantwell, Leslie, MO (US)

(73) Assignee: American Recreation Products, Inc., New Haven, MO (US)

( * ) Notice: Under 35 U.S.C. 154(b), the term of this patent shall be extended for 0 days.

(21) Appl. No.: 09/374,926

(22) Filed: Aug. 16, 1999

(51) Int. Cl.[7] ..... A47G 9/08
(52) U.S. Cl. ..... 5/413 R; 2/69.5
(58) Field of Search ..... 5/413 R, 413 AM, 5/485, 494, 486; 2/69.5, 69

(56) References Cited

U.S. PATENT DOCUMENTS

| | | | |
|---|---|---|---|
| 2,150,486 | 3/1939 | Bjornson | 5/334 |
| 2,675,552 | 4/1954 | Jackson | 2/69.5 |
| 2,832,967 | 5/1958 | Sobel | 5/334 |
| 2,999,244 | 9/1961 | Wright | 2/69.5 |
| 3,959,834 | 6/1976 | Hunt | 5/343 |
| 3,965,505 | 6/1976 | Thorowgood | 5/343 |
| 4,197,601 | 4/1980 | Maguire | 5/416 |
| 4,507,805 | 4/1985 | Calutoiu | 2/69.5 |
| 4,688,282 | 8/1987 | Jeffries | 5/413 |
| 4,894,878 | 1/1990 | Roach | 5/413 |
| 4,989,282 | 2/1991 | Goldstein | 5/413 |
| 5,152,017 | 10/1992 | Jaeger | 5/413 |
| 5,386,602 | 2/1995 | Krenzler | 5/413 |
| 5,473,779 | 12/1995 | Kramer | 2/69.5 |
| 5,560,043 | 10/1996 | Armstrong | 2/69.5 |
| 5,815,833 | 10/1998 | Kuo | 2/69.5 |

FOREIGN PATENT DOCUMENTS

| | | | |
|---|---|---|---|
| 1023202 * | 1/1958 | (DE) | 5/485 |

* cited by examiner

*Primary Examiner*—Terry Lee Melius
*Assistant Examiner*—Robert G. Santos
(74) *Attorney, Agent, or Firm*—Senniger, Powers, Leavitt & Roedel

(57) ABSTRACT

A sleeping bag having a compact foot space configuration for user warmth in cold ambient temperatures and an expanded foot space configuration for user comfort in mild to warm ambient temperatures. The sleeping bag includes an elongate shell defining a volume sized and shaped to receive a user therein. The shell has an outer surface, a head end portion, a foot end portion and left and right lateral sides. An opening extends generally along at least one of the lateral sides generally in the foot end portion. A pocket made of limp material and associated with the shell is generally in the opening. In the expanded configuration, the pocket and shell define a first foot space volume of the sleeping bag extending through the opening in the shell to a location spaced from the outer surface of the shell. In the compact configuration, the shell defines a second foot space volume and the pocket defines no volume outwardly of the shell opening, the first foot space volume being greater than the second foot space volume. A fastener is associated with the shell for closing the shell opening in the compact configuration of the sleeping bag.

13 Claims, 3 Drawing Sheets

SLEEPING BAG WITH ADJUSTABLE FOOT SPACE

BACKGROUND OF THE INVENTION

This invention relates generally to sleeping bags, and more specifically to a sleeping bag that is selectively convertible between a compact foot space configuration and an expanded foot space configuration.

Consumers face a difficult task in finding a sleeping bag that meets their needs over a wide variety of ambient temperatures in which the bag is intended to be used. Mummy-type sleeping bags are well suited for use in outdoor, cold ambient temperatures. Mummy bags generally minimize internal volume, being shaped with a lateral taper to approximately contour the body of a person. These bags are effective in conserving heat by decreasing air movement within the bag. A drawback to mummy bags is that some people feel discomfort in the relatively snug space of these bags. Their freedom of motion is reduced, especially at their feet, and they are too warm when the bag is used in warmer ambient temperatures. Rectangular-type sleeping bags are well suited for use indoors or in milder outdoor temperatures. These bags are shaped with a generally constant lateral dimension, providing generally good knee and foot room and freedom of motion. Although rectangular bags are generally more spacious than mummy bags, a drawback is that their larger internal volumes make them thermally inefficient. When used in colder environments, persons using rectangular bags can more easily become chilled, especially toward their feet.

Unfortunately, sleeping bag designs typically incorporate a one-type-fits-all approach, having volume and taper that are fixed. People who want to use bags in both colder and milder temperature environments must either purchase two bags (i.e., a mummy bag and a rectangular bag) at considerable expense, or get by with one bag designed for one environment but which is less than ideal in the other environment. Some users may have a personal preference for a snugger, warmer bag regardless of foot space. Other users prefer a roomier bag, regardless of its thermal characteristics. Unfortunately, no single type of sleeping bag is available that will please both.

SUMMARY OF THE INVENTION

Among the several objects and features of the present invention may be noted the provision of a sleeping bag for insulated and personal bedding that is adapted for use both indoors and outdoors over a wide range of ambient temperatures; the provision of such a sleeping bag that is selectively adjustable in lateral contour to accommodate personal preference; the provision of such a sleeping bag that is convertible between a compact foot space configuration and an expanded foot space configuration; and the provision of such a sleeping bag that is easy to use.

In general, a sleeping bag of the present invention has a compact foot space configuration for user warmth in cold ambient temperatures and an expanded foot space configuration for user comfort in mild to warm ambient temperatures. The sleeping bag comprises an elongate shell defining a volume sized and shaped to receive a user therein. The shell has an outer surface, a head end portion, a foot end portion and left and right lateral sides, and an opening extending generally along at least one of the lateral sides generally in the foot end portion. A pocket made of limp material and associated with the shell is generally in the opening. In the expanded configuration of the sleeping bag the pocket and shell define a first foot space volume of the sleeping bag extending through the opening in the shell to a location spaced from the outer surface of the shell, and in the compact configuration of the sleeping bag the shell defines a second foot space volume and the pocket defines no volume outwardly of the shell opening, the first foot space volume being greater than the second foot space volume. A fastener is associated with the shell for closing the shell opening in the compact configuration of the sleeping bag.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
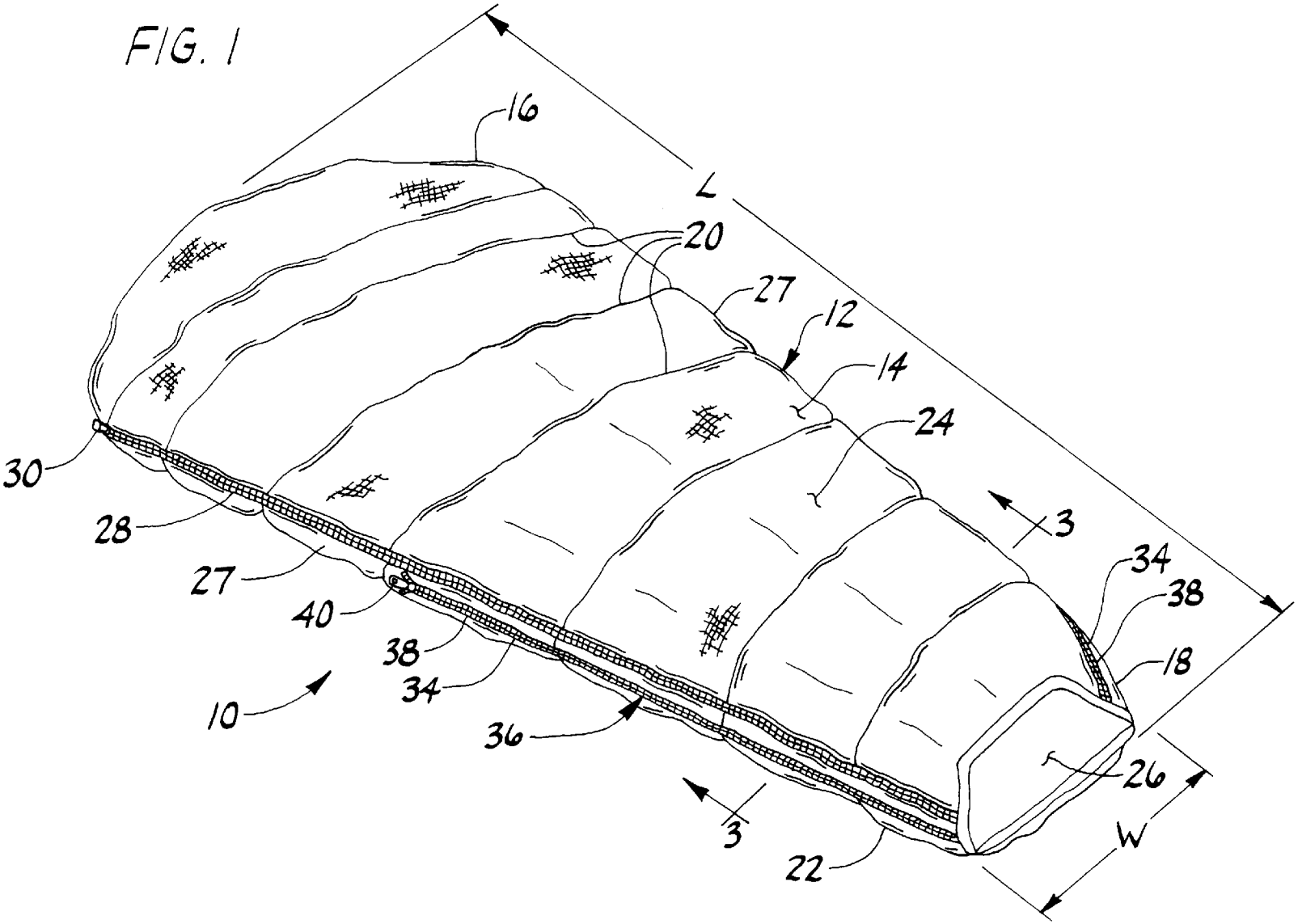
FIG. 1 is a perspective view of an adjustable sleeping bag of the present invention in a compact foot space configuration.
Figure 2:
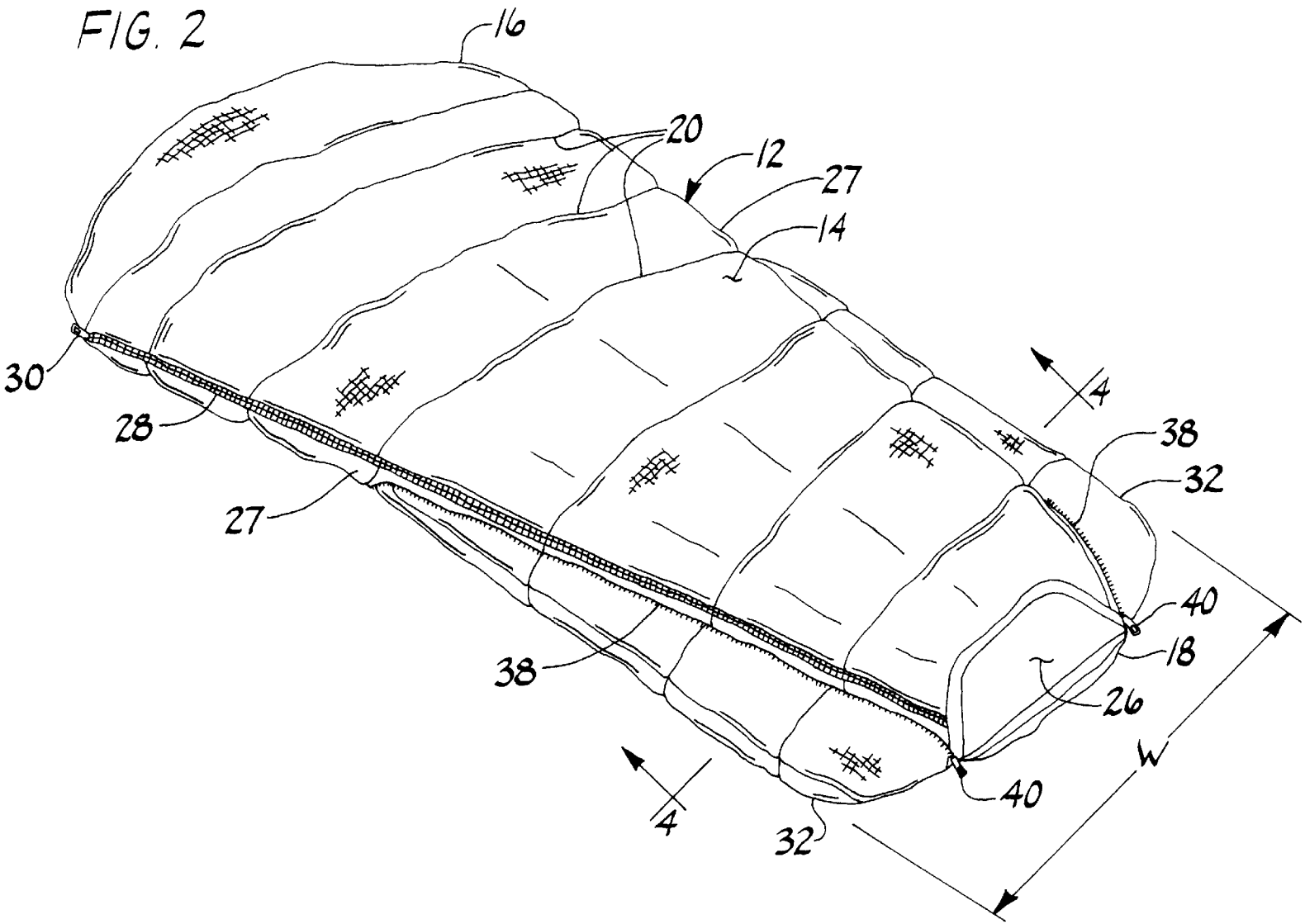
FIG. 2 is a perspective view of the sleeping bag in an expanded foot space configuration.

Referring now to the drawings and in particular to FIGS. 1 and 2, a sleeping bag of the present invention that is convertible between a compact foot space configuration and an expanded foot space configuration is indicated generally at 10. Like conventional sleeping bags of the prior art, the sleeping bag of the present invention provides a portable, insulated bed.

The sleeping bag 10 comprises an elongate shell 12 with suitable insulation which functions to conserve heat and provide generally soft padding between a person using the bag and an underlying surface on which the person sleeps. The shell 12 defines a volume sized and shaped to receive the person therein. The shell 12 has an outer surface 14, a head end portion 16 and a foot end portion 18, the head and foot end portions corresponding to the positions of the person's head and feet when using the bag. The outer surface of the shell 12 has several lateral rows of stitching 20 for joining fabric of the shell to internal insulation and for producing a pleasing external appearance. The bag 10 has a bottom section 22 which is intended to underlie the person and a top section 24 which overlies the person and is intended to cover the person.

A closure panel 26 at the foot end portion 18 is attached at its periphery to the bottom and top sections 22, 24 and to left and right lateral sides 27 of the bag to close the foot end portion. As shown in FIG. 1, the closure panel 26 is generally trapezoidal in shape, but it will be understood that other shapes do not depart from the scope of this invention. A closure 28 comprising a pair of engageable zipper tracks extends along the outer surface 14 of the shell for substantially its entire length at one of the lateral sides 27 of the shell. The tracks 28 are attached to the shell 12, one track being attached along a free edge margin of the bottom section 22 and the other track being attached along a free edge margin of the top section 24. A slide fastener 30 selectively joins the zipper tracks 28 to provide for partial separation of the top section 24 from the bottom section 22, allowing easy entry and egress by the person using the bag.

In accordance with the present invention, the sleeping bag 10 is convertible from the compact foot space configuration shown in FIG. 1 to an expanded foot space configuration, illustrated in FIG. 2, in which a lateral width W of the bag generally near the foot end portion 18 is extended to increase the available foot space volume inside the bag. In the compact configuration of FIG. 1, the sleeping bag 10 has the shape of a tapered, mummy-type bag. It provides relatively better warmth and is well suited for use in cold ambient temperatures. In the expanded configuration of FIG. 2, the sleeping bag 10 has the shape of a constant lateral dimension, rectangular-type bag. It provides more spacious volume for user comfort and is well suited for use in mild to warm ambient temperatures.

Figure 3:
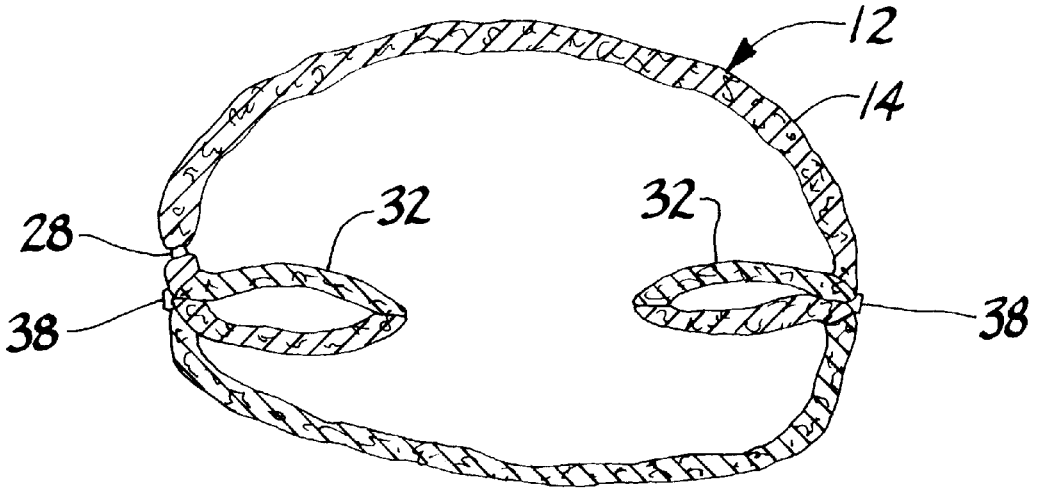
FIG. 3 is a sectional view taken on line 3—3 of FIG. 1.
Figure 4:
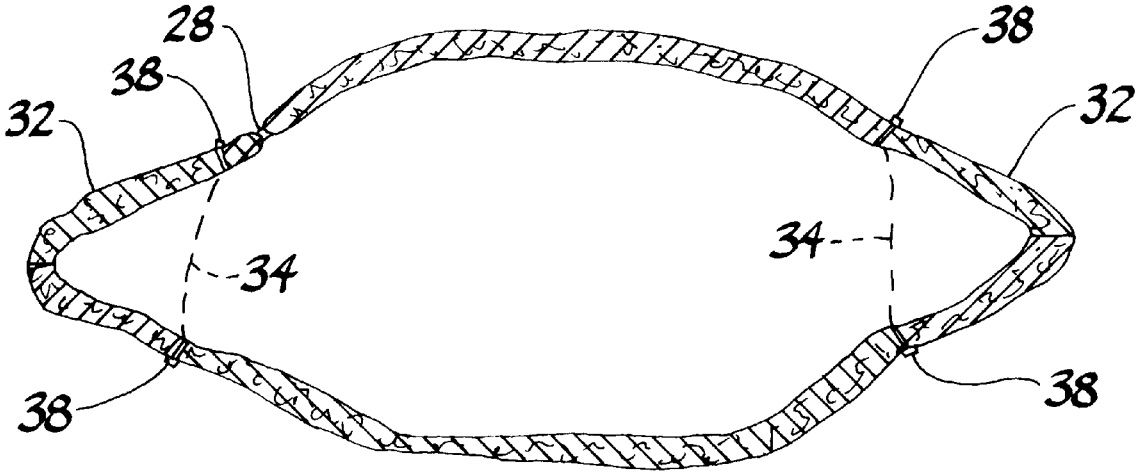
FIG. 4 is a sectional view taken on line 4—4 of FIG. 2.

The sleeping bag 10 has first and second pockets 32 collapsed within the shell 12 in the compact configuration, as shown in FIG. 3, that are expanded outside the shell in the expanded configuration, as shown in FIG. 4. The pockets 32 are expanded through openings 34 in left and right lateral sides 27 of the shell 12. Each opening 34 is selectively opened or closed using a fastener, generally designated 36, on the outer surface 14 of the shell. In the illustrated embodiment, the fastener 36 comprises a pair of engageable zipper tracks 38 extending along a lateral side of the shell 12 generally at the periphery of the opening 34, and a slide fastener 40. The zipper tracks 38 extend generally parallel to the zipper tracks 28 used to close and separate the top and bottom sections 24, 22 on the lateral side 27 of the shell that has the closure. Each opening 34 extends along the lateral side 27 of the shell a distance less than a full length L of the shell 12. In the preferred embodiment, each opening 34 extends from a location on the foot end portion 18, adjacent the closure panel 26, toward the head end portion 16 a distance that is slightly over half of the length L of the shell. Although two openings 34 and two pockets 32 are preferred, it is to be understood that only a single pocket may be provided without departing from the scope of the present invention.

The pockets 32 are sized and shaped to convert the shell 12 from a mummy-type lateral contour to a rectangular-type contour of approximately constant lateral width. The pockets are joined to the shell in the opening 34 so that the pocket is substantially contiguous with the shell. The pocket is made of a suitable limp material that permits it to be flexibly moveable and collapsible between the expanded configuration and the compact configuration. Preferably, the pocket 32 is made of the same insulated material as the shell.

In use, the sleeping bag 10 is readily changed from the compact foot space configuration (FIG. 1) to the expanded foot space configuration (FIG. 2) by using the slide fasteners 40 to disconnect the two zipper tracks 38 on the periphery of each opening 34. The pocket 32 is then pushed or pulled outwardly through the opening 34 and away from the shell 12. The shell and pocket now define a first foot space volume. The sleeping bag is readily changed back to the compact configuration by collapsing the pocket 32 within the opening 34 and moving the slide fastener 40 to close the opening and secure the pocket inside the shell. The shell 12 defines a second foot space volume and the pocket 32 defines no volume outside the shell.

Although the embodiment shown in FIGS. 1 and 2 shows a fastener 36 comprising a zipper, other types of fasteners are also contemplated as falling within the scope of this invention. These include, for example, interengageable hook and loop fasteners (VELCRO), buttons and buttonholes, and snaps and snap-receiving sockets.

The sleeping bag 10 of the present invention may have pockets in various alternate shapes and locations without departing from the scope of this invention. For instance, the shell may have only one pocket and one corresponding opening, or the opening may extend a shorter or longer distance along the length of the shell than shown in FIG. 1 and 2. Further, the opening need not be at the foot end, but may be anywhere along the bag. The sleeping bag can contain multiple pockets, thereby allowing many degrees of width adjustability.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A sleeping bag having a compact foot space configuration for user warmth in cold ambient temperatures and an expanded foot space configuration for user comfort in mild to warm ambient temperatures, the sleeping bag comprising:

an elongate shell defining a volume sized and shaped to receive a user therein, the shell having an outer surface, a head end portion, a foot end portion, left and right lateral sides, and an opening extending generally along at least one of the lateral sides generally in the foot end portion;

a pocket made of limp material and associated with the shell generally in the opening, in the expanded configuration of the sleeping bag the pocket and shell defining a first foot space volume of the sleeping bag extending through the opening in the shell to a location spaced from the outer surface of the shell, in the compact configuration of the sleeping bag the shell defining a second foot space volume and the pocket defining no volume outwardly of the shell opening, the first foot space volume being greater than the second foot space volume; and a fastener associated with the shell for closing the shell opening in the compact configuration of the sleeping bag.

2. A sleeping bag as set forth in claim 1 wherein the opening extends along said one lateral side of the shell a distance less than the full length of the shell.

3. A sleeping bag as set forth in claim 2 wherein the opening, the pocket and the fastener constitute a first opening, a first pocket and a first fastener, respectively, the shell further comprising a second opening extending along one of the lateral sides opposite the lateral side along which the first opening extends, a second pocket associated with the second opening, and a second fastener for closing the second opening in the compact configuration of the sleeping bag.

4. A sleeping bag as set forth in claim 3 wherein the first and second pockets are collapsed within the shell in the compact configuration of the sleeping bag and expanded outside the shell through the first and second openings, respectively, in the expanded configuration.

5. A sleeping bag as set forth in claim 4 wherein the first and second pockets are joined to the shell inside the first and second openings, respectively.

6. A sleeping bag as set forth in claim 5 wherein the sleeping bag tapers in lateral dimension in the foot end portion in the compact configuration and has a substantially constant lateral dimension in the foot end portion in the expanded configuration.

7. A sleeping bag as set forth in claim 5 wherein the first and second fasteners each comprise a zipper fastener.

8. A sleeping bag as set forth in claim 2 wherein the pocket is collapsed within the shell in the compact configuration of the sleeping bag and expanded outside the shell through the opening in the expanded configuration.

9. A sleeping bag as set forth in claim 8 wherein the pocket is joined to the shell inside the opening.

10. A sleeping bag as set forth in claim 9 wherein the sleeping bag tapers in lateral dimension in the foot end portion in the compact configuration and has a substantially constant lateral dimension in the foot end portion in the expanded configuration.

11. A sleeping bag as set forth in claim 9 wherein the fastener comprises a zipper fastener.

12. A sleeping bag as set forth in claim 1 wherein the shell comprises a top section and a bottom section, the top and bottom sections each having a free longitudinal edge margin, and a closure extending substantially the full length of the shell for releasably joining together the free edge margins of the top and bottom sections of the shell to facilitate the user's entry into and exit from the volume defined by the shell.

13. A sleeping bag having a compact foot space configuration for user warmth in cold ambient temperatures and an expanded foot space configuration for user comfort in mild to warm ambient temperatures, the sleeping bag comprising:

an elongate shell defining a volume sized and shaped to receive a user therein, the shell having an outer surface, a head end portion, a foot end portion, left and right lateral sides;

a pocket made of limp material and associated with the shell, generally located in the foot end portion, in the expanded configuration of the sleeping bag the pocket and shell jointly defining a continuous first foot space volume of the sleeping bag, in the compact configuration of the sleeping bag the shell defining a second foot space volume and the pocket defining no foot space volume, the first foot space volume having a greater dimension laterally of the sleeping bag than the second foot space volume.

* * * * *